US005557170A

United States Patent [19]

Ooms

[11] Patent Number: 5,557,170

[45] Date of Patent: Sep. 17, 1996

[54] LOW-PRESSURE DISCHARGE LAMP AND METHOD OF MANUFACTURING A LOW-PRESSURE DISCHARGE LAMP

[75] Inventor: Pieter C. Ooms, Roosendaal, Netherlands

[73] Assignee: U.S. Philips Corporation, New York, N.Y.

[21] Appl. No.: 362,038

[22] Filed: Dec. 22, 1994

[30] Foreign Application Priority Data

Dec. 24, 1993 [BE] Belgium ..... 09301462

[51] Int. Cl.[6] ..... H01J 9/20; H01J 61/35

[52] U.S. Cl. ..... 313/635; 313/110; 445/26; 445/58; 445/59

[58] Field of Search ..... 313/635, 110, 313/113, 117; 445/26, 58, 59; 427/271, 279, 331

[56] References Cited

U.S. PATENT DOCUMENTS 3,717,781 2/1973 Sadoski et al. ..... 313/635
3,875,454 4/1975 Van Der Wolf et al. ..... 313/635
4,080,545 3/1978 Gallo ..... 313/635

FOREIGN PATENT DOCUMENTS 0464723 1/1992 European Pat. Off. ..... H01J 9/20

*Primary Examiner*—Nimeshkumar D. Patel
*Attorney, Agent, or Firm*—Brian J. Wieghaus

[57] ABSTRACT

An electric lamp has a tubular discharge vessel or a lamp envelope with an optically active layer of a material at an inner surface. The optically active layer has window in which the layer is absent. The material of the optically active layer adjacent both to the window and to the wall of the discharge vessel has a form different from that of portions of the optically active layer not adjoining the window as a result of fusion. The lamp may be readily manufactured by a method according to the invention whereby the material situated within the window to be formed is removed by intensive electromagnetic radiation which is directed through the wall of the discharge vessel at the material to be removed.

16 Claims, 3 Drawing Sheets

LOW-PRESSURE DISCHARGE LAMP AND METHOD OF MANUFACTURING A LOW-PRESSURE DISCHARGE LAMP

BACKGROUND OF THE INVENTION

The invention relates to a low-pressure discharge lamp provided with a tubular discharge vessel having an axis and having a wall which encloses a discharge space containing an ionizable filling in a gastight manner, while a pair of electrodes are arranged in the discharge space and the wall of the discharge vessel is provided with an optically active layer of a material at an inner surface, which optically active layer is interrupted by an elongate window extending in the direction of the axis.

The invention also relates to a method of manufacturing such a low-pressure discharge lamp wherein the material of the optically active layer is provided on said inner surface, after which the material situated within the window to be formed is removed.

In the present description and claims, the term "optically active layer" is understood to mean a layer on or in which an interaction with the radiation originating from the discharge space takes place. It is achieved by means of the window in the optically active layer that the radiation emitted by the lamp through the window has a comparatively high intensity compared with the intensity of the radiation of lamps having an optically active layer extending over the entire inner surface. Such lamps are highly suitable for applications where a comparatively high intensity of the light source is required, such as in an LCD unit or applications where the radiation originating from the lamp must be concentrated into a line-shaped region, such as in a device for the automatic reading of documents.

A method of the kind mentioned in the opening section by which such lamps can be manufactured is known from EP 0 464 723 A2. In the known method, a scraping member is moved through the discharge vessel and pressed against the wall by means of a magnetic field. In this manner a window is exposed within the optically active layer in the lamp, in this case a luminescent layer and/or a reflecting layer.

A disadvantage of the known method is that the contact between the lamp and the tool by which the window is provided may easily lead to defects of the lamp. The scraping member, for example, may introduce impurities into the discharge vessel. Moreover, the scraping member is subject to wear because it is in contact with the discharge vessel while moving. Wear of the scraping member may result in damage to the discharge vessel wall and/or an imperfect removal of material within the window to be formed.

In the publication cited above, the use of the method is described for lamps whose discharge vessels have an internal diameter of between approximately 3.75 and 5.25 min. In proportion as the discharge vessel diameter, and thus the maximum admissible cross-section of the scraping member decreases, the magnetic field exerts a smaller force on the scraping member. The effectiveness with which the material within the window is removed is reduced thereby. During scraping away of material for forming a window, the material scraped away is usually removed by means of a gas, for example air, which is made to flow through the discharge vessel in order to render possible an unhampered movement of the scraping member. As the discharge vessel diameter is smaller, however, there will be less space between the scraping member and the discharge vessel available for allowing the gas to pass. This may result in an insufficient removal of the material from the discharge vessel, so that it hampers the movement of the scraping member.

SUMMARY OF THE INVENTION

It is an object of the invention to provide a lamp of the kind mentioned in the opening paragraph which renders physical contact with the tool required for forming the window unnecessary.

According to the invention, the lamp of the kind mentioned in the opening paragraph is for this purpose characterized in that material of the optically active layer adjacent both to the window and to the wall has been fused. The material adjacent both to the window and to the wall is different, for example, in that particles thereof have assumed a droplet shape, or have been fused together.

The lamp according to the invention may be readily manufactured by a method according to the invention which is characterized in that intensive electromagnetic radiation is directed through the wall of the discharge vessel at the material to be removed. The term "intensive electromagnetic radiation", referred to hereinafter as i.e.m. radiation, is understood to mean herein electromagnetic radiation which has a power density which is at least a few orders of magnitude greater than that of the radiation generated during lamp operation.

It was found that material disappears from the window in this manner. Contact between the tool and the lamp, in particular the presence of a scraping member in the discharge vessel, is unnecessary then. The inventor has recognized that the irradiation of the material has the following effect. The i.e.m. radiation which is directed through the wall at the material to be removed is absorbed in this material, so that it is heated and evaporates. At a very high intensity of the i.e.m. radiation, the vapour pressure evolved thereby is so high that material adjoining the evaporated material is pressed away. As a result inter alia of the i.e.m. radiation scattered into the wall of the discharge vessel, portions of the optically active layer adjacent to the window are heated to such a degree that the material of the layer melts at least partly, but does not evaporate. The material adjacent to the window and to the wall has thus obtained a shape changed by fusion compared with the remaining material.

In the method according to the invention, the removal of material of the optically active layer from the window may take place in any stage of the manufacturing process after the provision of the layer. The window may be formed, for example, immediately after the optically active layer has been provided on the inner surface of the discharge vessel. The material of the optically active layer may be provided, for example, in that a suspension is applied, or through electrostatic coating. The method may comprise sintering of the optically active layer, for example, if the layer material was provided in the form of a suspension. Sintering is here understood to mean heating the layer in an atmosphere containing oxygen, for example, by adding air so as to remove auxiliary substances present in the layer, such as binders. This may take place, for example, immediately after the material of the optically active layer was provided, or after the window was formed in the layer.

In an embodiment, the removal of the material from the window takes place as the last manufacturing step. In this case, for example, the optically active layer was provided in suspension form, then sintered, after which the discharge vessel is evacuated, provided with electrodes and with an ionizable filling, for example a filling of mercury and a rare gas such as argon, and closed in a gastight manner, before the window in the optically active layer is formed by means of i.e.m. radiation. It is very favourable that the formation of the window can take place in a late stage in the manufacture of the lamp. On the one hand, this renders it possible for lamps having windows and lamps having an uninterrupted layers to pass through the same production line for the major part and to have the same components. On the other hand, this renders it possible, if so desired, to manufacture lamps of the former type from lamps of the latter type already available at short notice without the entire production line having to be used.

Those skilled in the art may readily determine the i.e.m. radiation duration and intensity required for a specific material in a few experiments. A decrease in the radiation duration may be compensated with an increase in the power density of the i.e.m. radiation, and vice versa, within a comparatively wide range. An irradiation with a certain duration may be realised in that a beam of i.e.m. radiation is moved over the wall surface. The radiation duration in locations covered by the beam is then proportional to the diameter of the beam in the direction of movement and inversely proportional to the speed with which the beam moves. Alternatively, the beam may be focused into the shape of the window to be formed, the i.e.m. radiation source being activated during the desired radiation time.

A practical embodiment of the method according to the invention is characterized in that the i.e.m. radiation is generated by a laser. The beam obtained with a laser may be moved over the surface of the discharge vessel and the shape of the beam may be adjusted by simple optical means. Favourable results were obtained with an infrared laser. The use of a pulse-operated laser offers further possibilities for adjusting the radiation time through a choice of the pulse duration and the repetition frequency of the pulses.

The laser beam is directed, for example with mirrors, over that portion of the discharge vessel where the window is to be created in the optically active layer. Alternatively, the laser beam may be guided towards the surface, for example through a flexible optical waveguide. In yet another embodiment, the discharge vessel is guided, for example on a conveyer belt, through a beam which follows a fixed path.

The optically active layer may support a further optically active layer. In an embodiment, for example, the optically active layer is a reflecting layer, for example made of MgO or $Al_2O_3$, and supports a luminescent layer which forms a further optically active layer. The presence of the reflecting layer has a favourable influence on the light output in the window. In an embodiment, the luminescent layer extends over the entire inner surface, i.e. also over the window in the reflecting layer. Alternatively, the luminescent layer may have a window as does the reflecting layer. In the manufacture of this embodiment of a lamp, the luminescent layer may be provided after the reflecting layer was provided with a window. A window may then be provided in the luminescent layer in that the i.e.m. radiation is directed at the luminescent layer through the window in the reflecting layer. Alternatively, a window may be formed simultaneously in the luminescing and the reflecting layer after these two layers were provided on the wall.

In a particularly advantageous embodiment of the lamp according to the invention, the discharge vessel has an internal diameter of at most 3 mm. In the lamp according to the invention, a discharge vessel having also this internal diameter does not form an obstruction to the tool. The comparatively small window of a lamp according to this embodiment, for example, a lamp having an internal diameter of 0.5 mm, in fact renders it possible to manufacture the lamp comparatively easily. In a method of manufacturing whereby an i.e.m. radiation beam is moved relative to the discharge vessel, comparatively few movements can suffice for traversing the surface of the window to be formed. In a manufacturing method whereby the i.e.m. radiation is formed into a beam having the shape of the window to be formed, the i.e.m. radiation source may have a comparatively low power.

BRIEF DESCRIPTION OF THE INVENTION

An embodiment of the low-pressure discharge lamp according to the invention and an embodiment of the method according to the invention are explained in more detail with reference to the drawing.

FIG. 3 shows the discharge vessel subjected to the method in elevation, while FIG. 4 is a longitudinal section of the discharge vessel taken on IV—IV in FIG. 3.

DESCRIPTION OF THE PREFERRED EMBODIMENTS

Figure 1:
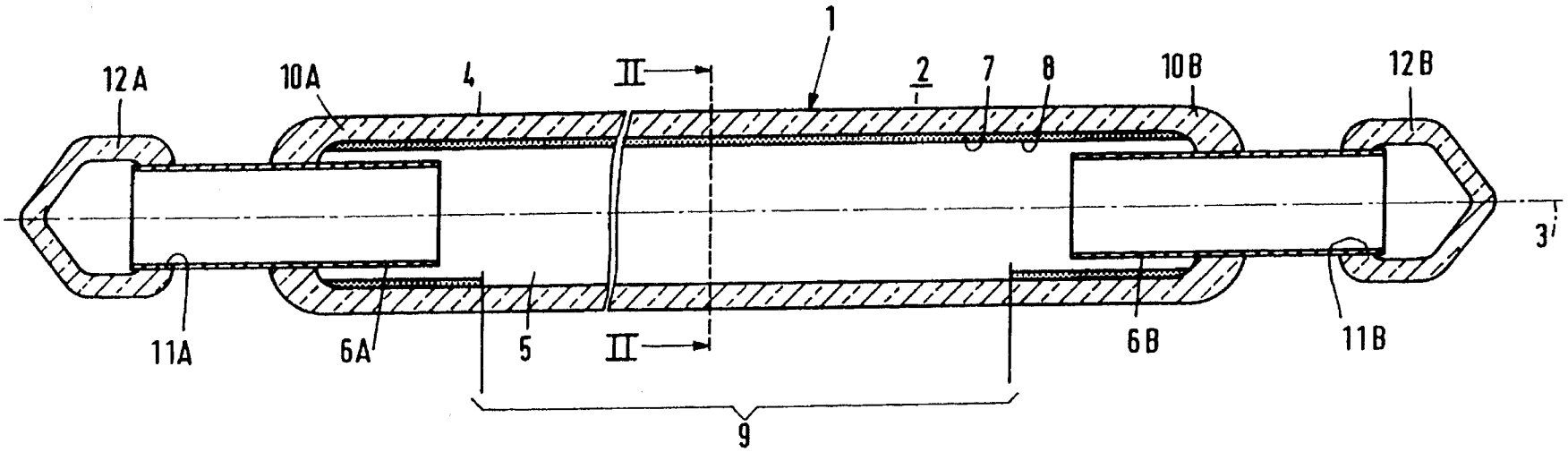
FIGS. 1 and 2 show a longitudinal section and a cross-section (taken on II—II in FIG. 1) of a lamp according to the invention, respectively.
Figure 2:
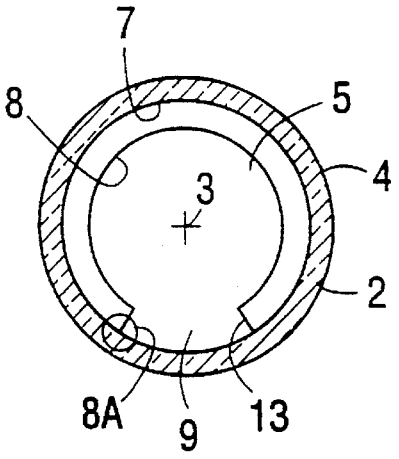

FIGS. 1 and 2 show a lamp 1, here a low-pressure discharge lamp with a tubular discharge vessel 2. The discharge vessel 2 with an axis 3 has a length of 23 cm, and a wall 4 of 0.85 mm thickness. The wall 4 encloses a discharge space 5, provided with a filling of mercury and argon, in a gastight manner. A pair of electrodes 6A, 6B is arranged in the discharge space 5. The electrodes 6A, 6B are constructed as metal bushes. The wall 4 of the discharge vessel 2 is provided with an optically active layer 8 at an inner surface 7, herewith a luminescent layer comprising 40% by weight ceriummagnesium aluminate activated by trivalent terbium (CAT), 27% by weight bariummagnesium aluminate activated by bivalent europium (BAM), and 33% by weight yttrium oxide activated by trivalent europium (YOX), and having a thickness of approximately 25 μm. The luminescent layer 8 is interrupted by an elongate window 9 with a width of 0.9 mm which extends over a length of 15 cm along the axis 3 of the discharge vessel 2. The discharge vessel 2 of the lamp 1 has an internal diameter of 2.55 min. The material of the optically active layer 8 adjacent both to the window 9 and to the wall 4 of the discharge vessel 2 has been fused.

Figure 4:
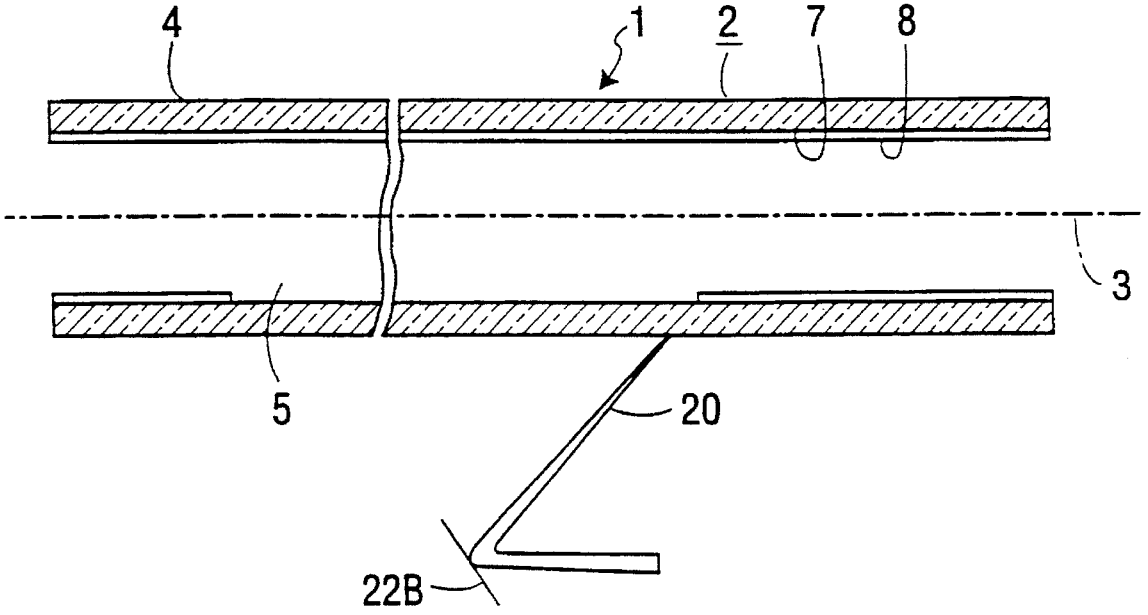
FIGS. 3 and 4 show an embodiment of a step in the manufacture by a method according to the invention.
Figure 3:
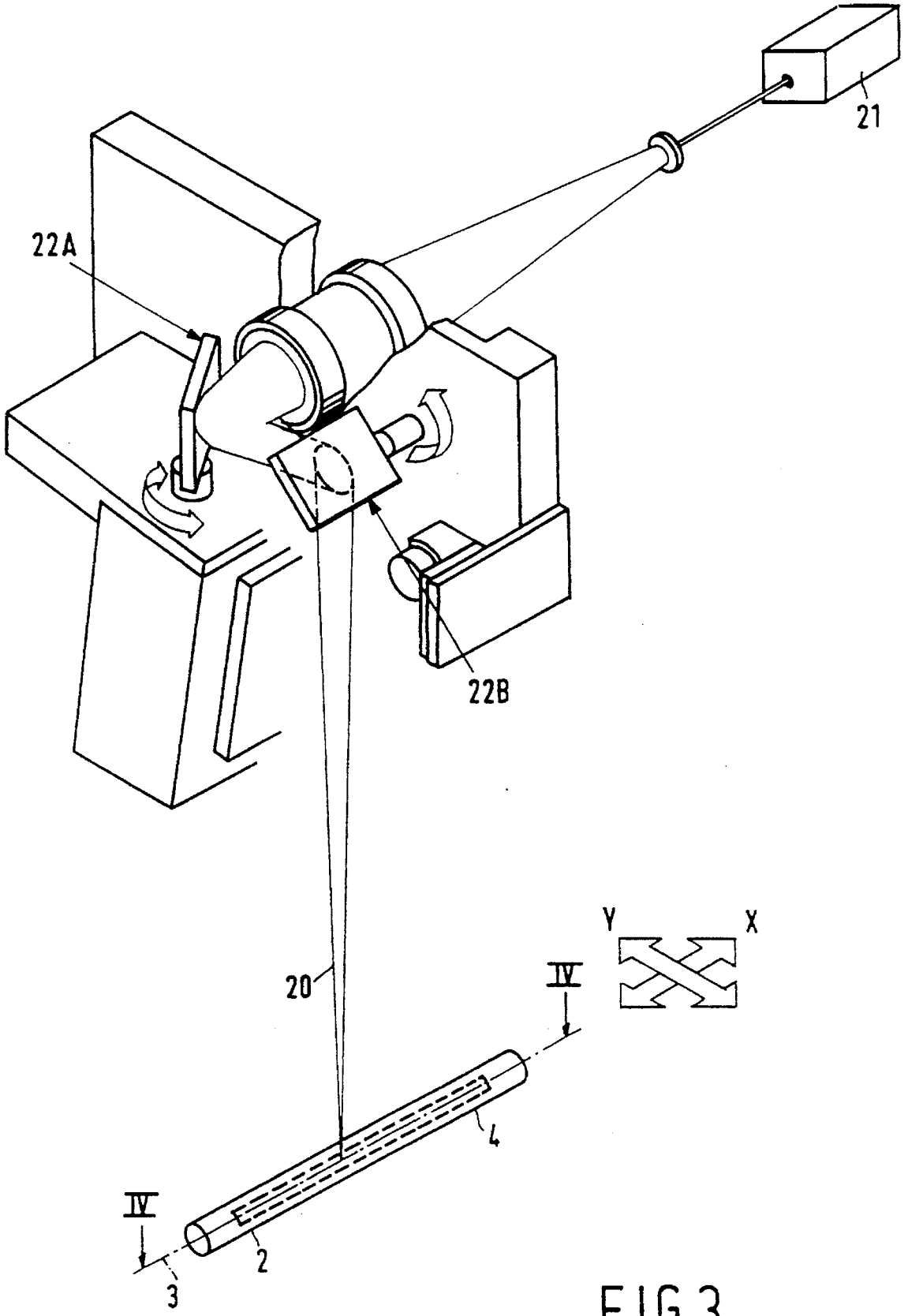

The lamp was manufactured as follows (see FIGS. 3 and 4). The layer 8 was provided on the inner surface 7 of the discharge vessel 2 in the form of a suspension. Then the layer 8 was interrupted with a window 9 as follows. I.e.m. radiation 20 was aimed through the wall 4 of the discharge vessel 2 at the material to be removed. The i.e.m. radiation 20 was generated with an Nd-YAG laser 21. A beam was obtained with the laser 21 with a wavelength of 1.06 μm and a half-value diameter of 0.2 mm at the area of the wall 4 of the discharge vessel 2. The laser 21 was pulse-operated with a frequency of 1500 Hz. I.e.m. radiation pulses were generated thereby with a power density of approximately $3\times10^{10}$ W/m$^2$, a duration of 200 ns, and a total energy of 2 mJ. A mirror 22A moved the beam 20 to and fro over the surface with a speed of 150 mm/s in the longitudinal direction X. In an interval between each movement and the subsequent movement in the opposite direction, the beam was displaced over a distance of 0.08 mm in the perpendicular direction Y by mirror 22B.

The manufacture of the lamp of FIGS. 1 and 2 was completed as follows after the provision of the window 9 in the luminescent layer 8 and after sintering of the layer 8. The metal bushes 6A, 6B were provided in the two ends 10A, 10B of the discharge vessel 2. Bush 6A was provided with a glass seal 12A at its end 11A facing away from the discharge vessel 2. The other electrode 6B was provided with a glass exhaust tube 12B at its end facing away from the discharge vessel 2. After the discharge vessel 2 had been evacuated through the exhaust tube 12B and provided with a filling of mercury and argon, the exhaust tube 12B was fused at the end facing away from the electrode 6B, so that the wall 4 of the discharge vessel 2 enclosed the discharge space 5 in a gastight manner. SEM pictures of the lamp 1 showed that some particles of material 8A (see FIG. 2) of the luminescent layer 8 adjacent both to the window 9 and to the wall 4 had assumed a droplet shape owing to fusion, while other particles had been fused together.

Lamps of the same construction and dimensions as that shown in FIGS. 1 and 2 were manufactured by an alternative embodiment of the method according to the invention. According to this embodiment, the window was provided in the layer as the last step in the manufacturing process. Given the same power, it was found that an approximately five times shorter radiation duration sufficed to remove the material. In some cases, black spots were found to arise on the discharge vessel. It is assumed that these spots result from the evaporation and re-deposition of mercury and mercury compounds when the window is irradiated with i.e.m. radiation. It is assumed that this effect can be avoided in that mercury is not dosed until after the irradiation has been completed, or in that the lamp is provided with a mercury-free filling, for example a filling of xenon or neon.

Lamps were subsequently manufactured with discharge vessels having an internal diameter of 1.5 mm by the same embodiment of the method according to the invention.

I claim:

1. A low-pressure discharge lamp comprising a tubular discharge vessel having an axis and a wall which encloses a discharge space in a gastight manner, an ionizable filling in the discharge space, a pair of electrodes in the discharge vessel, and an optically active layer of a material at an inner surface of the wall of the discharge vessel, which optically active layer is interrupted by an elongate window extending in the direction of the axis, characterized in that the optically active layer adjacent both to the window and to the wall has fused material.

2. A low-pressure discharge lamp as claimed in claim 1, characterized in that the discharge vessel of the lamp has an internal diameter of at most 3 mm.

3. A discharge lamp according to claim 2, wherein said optically active layer comprises luminescent material comprised of phosphor particles and said fused material is at least one of (i) particles having a droplet shape owing to fusion and (ii) particles fused together.

4. A discharge lamp according to claim 1, wherein said optically active layer comprises luminescent material comprised of phosphor particles and said fused material is at least one of (i) particles having a droplet shape owing to fusion and (ii) particles fused together.

5. An electric lamp, comprising:

a lamp envelope having an inner surface with an optically active layer of a material comprised of particles; and means for generating a radiation-emitting discharge within said lamp envelope, said optically active layer having a window in which said optically active layer is absent, said window having a boundary with said optically active layer in which material of the optically active layer adjacent said inner surface is at least one of (i) particles having a droplet shape owing to fusion and (ii) particles fused together.

6. An electric lamp according to claim 5, wherein said optically active layer comprises a phosphor.

7. A method of manufacturing a low-pressure discharge lamp having a tubular discharge vessel with an axis, a wall enclosing a discharge space in a gastight manner, an ionizable filling and a pair of electrodes arranged in the discharge space, and an optically active layer of a material at an inner surface of the wall of the discharge vessel, which optically active layer is interrupted by an elongate window extending in the direction of the axis, by which method the material of the optically active layer is provided on said inner surface, after which the material situated within the window to be formed is removed, characterized in that: intensive electromagnetic radiation is directed through the wall of the discharge vessel at the material to be removed.

8. A method as claimed in claim 7, characterized in that the intensive electromagnetic radiation is generated with a laser.

9. A method according to claim 7, wherein said optically active layer comprises luminescent material comprised of phosphor particles and, at boundary of said window, said phosphor particles are at least one of (i) particles having a droplet shape owing to fusion and (ii) particles fused together.

10. A method according to claim 7 wherein said optically active layer comprises luminescent material comprised of phosphor particles and, at the boundary of said window, said phosphor particles are at least one of (i) particles having a droplet shape owing to fusion and (ii) particles fused together.

11. A method according to claim 7, wherein said discharge vessel has an internal diameter of at most 3 mm.

12. A method of manufacturing an electric lamp having a lamp envelope with an inner surface and an optically active layer on a portion of the inner surface, the optically active layer having a window therein in which the optically active layer is absent, said method comprising the steps of:

providing the optically active layer on the portion of the inner surface of the lamp envelope; and forming the window by directing intensive electromagnetic radiation through the wall of the lamp envelope to remove the optically active layer within the window.

13. A method according to claim 12, wherein the intensive electromagnetic radiation is generated with a laser.

14. A method according to claim 13, wherein said laser is an infrared laser.

15. A method according to claim 14, wherein said optically active layer comprises luminescent material comprised of phosphor particles.

16. A method to claim 12, wherein said optically active layer is supplied as suspension to the inner surface of the lamp envelope and then sintered, followed by said step of directing the radiation through the lamp envelope.

* * * * *